US005496421A

United States Patent [19]

Hashizume et al.

[11] Patent Number: 5,496,421

[45] Date of Patent: Mar. 5, 1996

[54] HIGH-STRENGTH MARTENSITIC STAINLESS STEEL AND METHOD FOR MAKING THE SAME

[75] Inventors: Shuji Hashizume; Yusuke Minami; Yoshiichi Ishizawa, all of Kawasaki, Japan

[73] Assignee: NKK Corporation, Tokyo, Japan

[21] Appl. No.: 324,268

[22] Filed: Oct. 17, 1994

[30] Foreign Application Priority Data

Oct. 22, 1993 [JP] Japan ..... 5-264909

[51] Int. Cl.[6] ..... C22C 38/42; C21D 9/00

[52] U.S. Cl. ..... 148/326; 148/607

[58] Field of Search ..... 148/607, 326

[56] References Cited

U.S. PATENT DOCUMENTS 3,336,168 8/1967 Morita et al. ..... 148/607

FOREIGN PATENT DOCUMENTS 58-199850 11/1983 Japan .
60-174859 9/1985 Japan .
61-3391 1/1986 Japan .
61-207550 9/1986 Japan .
62-54063 3/1987 Japan .

*Primary Examiner*—Deborah Yee
*Attorney, Agent, or Firm*—Frishauf, Holtz, Goodman, Langer & Chick

[57] ABSTRACT

A high strength martensitic stainless steel contains:

0.06 wt. % or less C, 12 to 16 wt. % Cr, 1 wt. % or less Si, 2 wt. % or less Mn, 0.5 to 8 wt. % Ni, 0.1 to 2.5 wt. % Mo, 0.3 to 4 wt. % Cu, 0.05 wt. % or less N, and the balance being Fe and inevitable impurities;

said steel having an area ratio of δ-ferrite phase of at most 10%; and said steel having fine copper precipitates dispersed in a matrix.

And further a method for making the stainless steel comprises austenitizing, cooling and tempering.

40 Claims, 1 Drawing Sheet

HIGH-STRENGTH MARTENSITIC STAINLESS STEEL AND METHOD FOR MAKING THE SAME

BACKGROUND OF THE INVENTION

1. Field of the Invention

The present invention relates to a high-strength martensitic stainless steel having excellent anti-stress corrosion cracking property and a method for making the same, and more particularly to a high-strength martensitic stainless steel showing excellent anti-stress corrosion cracking property in an environment containing $CO_2$ and $H_2S$ in such a case of drilling and transporting crude oil and natural gas, and a method for making the same.

2. Description of the Related Arts

Crude oil and natural gas recently extracted often contain large amounts of $CO_2$ and $H_2S$. To cope with this, martensitic stainless steels such as 13Cr stainless steel are adopted instead of conventional carbon steel.

Ordinary martensitic stainless steels, however, have superior corrosion resistance to $CO_2$ (hereinafter referred to simply as "corrosion resistance") but have insufficient stress-corrosion cracking resistance to $H_2S$ (hereinafter referred to simply as "anti-stress corrosion cracking property"). Accordingly, a martensitic stainless steel having improved anti-stress corrosion cracking property while maintaining favorable strength, toughness, and corrosion resistance has long been wanted.

Materials which satisfy the requirements of strength, toughness, and corrosion resistance, and also of anti-stress corrosion cracking property are disclosed in Examined Japanese Patent Publication No. 61-3391, Unexamined Japanese Patent Publication No. 58-199850 and 61-207550. Those materials show a resistance to an environment containing only a slight quantity of $H_2S$, but they generate stress-corrosion cracking in an environment at over 0.01 atm. of $H_2S$ partial pressure. So those materials can not be used in an environment containing a large amount of $H_2S$.

On the other hand, some of martensitic stainless steels which have an improved anti-stress corrosion cracking property in an environment exceeding 0.01 atm. of $H_2S$ partial pressure are introduced. Examples of that type of martensitic stainless steel are disclosed in Unexamined Japanese Patent Publication Nos. 60-174859 and 62-54063. Those materials are, however, also unable to completely prevent stress corrosion cracking caused by $H_2S$. From the viewpoint of strength, a trial for improving the strength on all the martensitic stainless steels described above resulted in a significant degradation of their toughness and anti-stress corrosion cracking property. Accordingly, all those martensitic stainless steels have an unavoidable problem in that either toughness or anti-stress corrosion cracking property is sacrificed. As a result, those martensitic stainless steels can not be used as a deep OCTG (Oil Country Tubular Goods), for example, for which a high strength, anti-stress corrosion cracking property, anti-corrosion property, and toughness at the same time is requested.

SUMMARY OF THE INVENTION

It is an object of the present invention to provide a high-strength martensitic stainless steel which is applicable even in an environment containing a large amount of $H_2S$ while maintaining corrosion resistance by improving the conventional martensitic stainless steel in terms of strength, anti-stress corrosion cracking property, and toughness at the same time, and provides a method for making thereof. To achieve the object, the present invention provides a high strength stainless steel consisting essentially of:

0.06 wt. % or less C, 12 to 16 wt. % Cr, 1 wt. % or less Si, 2 wt. % or less Mn, 0.5 to 8 wt. % Ni, 0.1 to 2.5 wt. % Mo, 0.3 to 4 wt. % Cu, 0.05 wt. % or less N, and the balance being Fe and inevitable impurities;

said steel having an area ratio of δ-ferrite phase of at most 10%; and said steel having fine copper precipitates dispersed in a matrix.

The present invention provides another high strength stainless steel consisting essentially of:

0.06 wt. % or less C, 12 to 16 wt. % Cr, 1 wt. % or less Si, 2 wt. % or less Mn, 0.5 to 8 wt. % Ni, 0.1 to 2.5 wt. % Mo, 0.3 to 4 wt. % Cu, 0.05 wt. % or less N, at least one element selected from the group consisting of 0.01 to 0.1 wt. % V and 0.01 to 0.1 wt. % Nb and the balance being Fe and inevitable impurities;

said steel having an area ratio of δ-ferrite phase of 10% or less; and said steel having fine copper precipitates dispersed in a matrix.

Moreover, the present invention provides a method for making a high strength stainless steel comprising the steps of:

preparing a martensitic stainless steel steel consisting essentially of 0.06 wt. % or less C, 12 to 16 wt. % Cr, 1 wt. % or less Si, 2 wt. % or less Mn, 0.5 to 8 wt. % Ni, 0.1 to 2.5 wt. % Mo, 0.3 to 4 wt. % Cu, 0.05 wt. % or less N, and the balance being Fe and inevitable impurities;

austenitizing said martensitic stainless steel at a temperature of $Ac_3$ transformation point to 980° C. to produce a austenitized martensitic steel;

cooling the austenitized martensitic stainless steel;

tempering the cooled stainless steel to disperse fine Cu precipitate grains in a matrix at a tempering temperature (T° C.) of 500° C. to lower one of either 630° C. or $Ac_1$ transformation point and at a tempering time (t hour), said tempering temperature and said tempering time satisfying the following equation;

$$15200 \leqq (20+\log t)(273+T) \leqq 17800.$$

The present invention provides another method for making a high strength stainless steel comprising the steps of:

preparing a martensitic stainless steel steel consisting essentially of 0.06 wt. % or less C, 12 to 16 wt. % Cr, 1 wt. % or less Si, 2 wt. % or less Mn, 0.5 to 8 wt. % Ni, 0.1 to 2.5 wt. % Mo, 0.3 to 4 wt. % Cu, 0.05 wt. % or less N, at least one element selected from the group consisting of 0.01 to 0.1 wt. % V and 0.01 to 0.1 wt. % Nb and the balance being Fe and inevitable impurities; and the balance being Fe, and inevitable impurities;

austenitizing said martensitie stainless steel at a temperature of $Ac_3$ transformation point to 980° C. to produce a austenitized martensitie steel;

cooling the austenitized martensitie stainless steel;

tempering the cooled stainless steel to disperse fine Cu precipitate grains in a matrix at a tempering temperature (T° C.) of 500° C. to lower one of either 630° C. or $Ac_1$ transformation point and at a tempering time (t hour), said tempering temperature and said tempering time satisfying the following equation;

$$15200 \leqq (20+\log t)(273+T) \leqq 17800.$$

BRIEF DESCRIPTION OF THE DRAWING

The Figure shows the relation of the 0.2% yield stress, the Charpy impact energy, and the temper parameter.

DESCRIPTION OF THE PREFERRED EMBODIMENT

Figure 1:
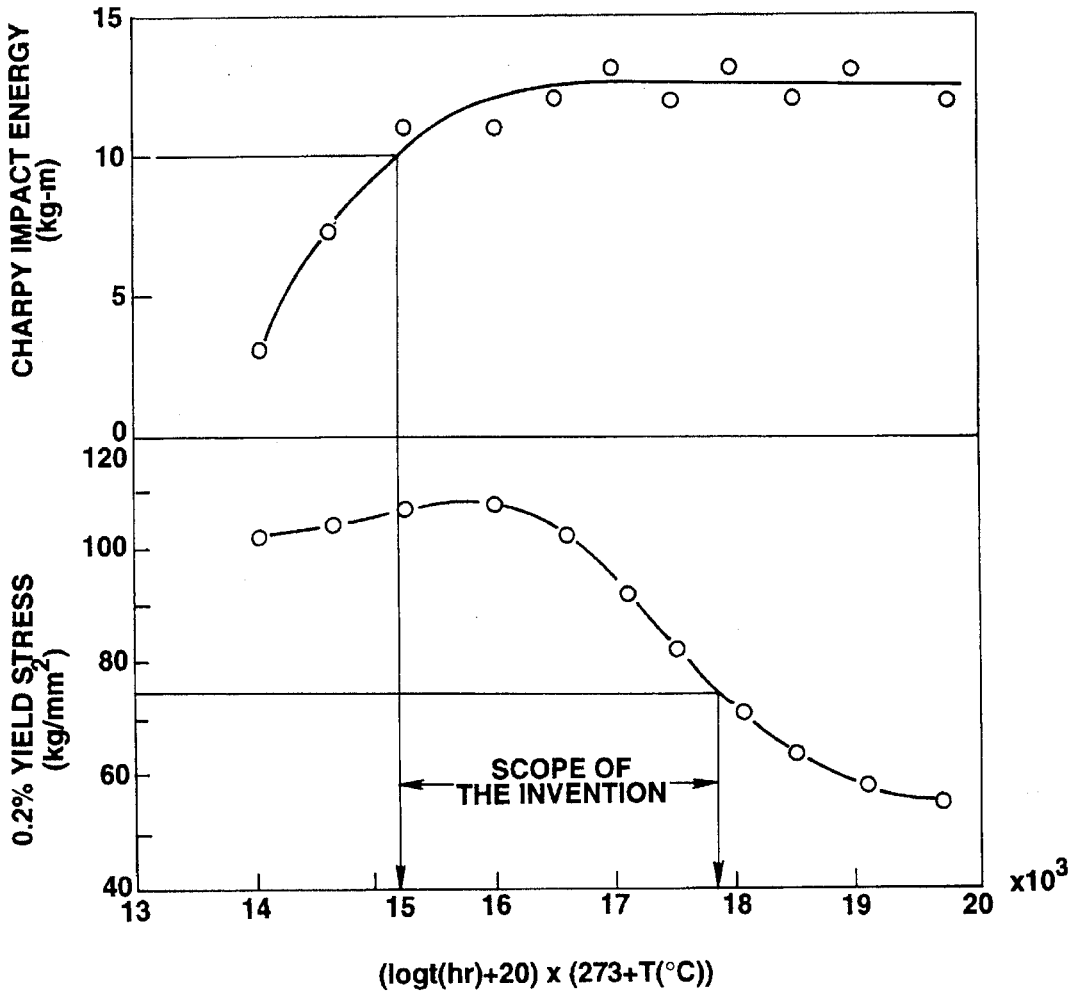

The present invention provides a high-strength martensitic stainless steel which is applicable even in an environment containing a large amount of $H_2S$ while maintaining corrosion resistance by improving the conventional martensitic stainless steel in terms of strength, anti-stress corrosion cracking property, and toughness at the same time, and provides a method for the manufacturing thereof. The target performance is specified as follows considering the requirements with regard to the drilling and transporting steel pipes for crude oil and natural oil which contain $CO_2$ and $H_2S$.

Strength: The 0.2% yield stress is 75 kg/mm$^2$ or more.

Toughness: Absorbed energy on a charpy full size specimen at 0° C. (called the Charpy impact energy) is 10 kg-m or more.

Anti-stress corrosion cracking property: When a specimen is loaded at a 60% loading of the 0.2% yield stress in a mixture of 5% NaCl solution and 0.5% acetic acid aqueous solution saturated with $H_2S$ gas of 1 atm, the specimen is durable for 720 hours or longer without failure.

Increasing the Cr is an effective means to improve the corrosion resistance of a martensitic stainless steel. However, the increase in the Cr content induces the generation of δ-ferrite phase which, in turn, degrades the strength and toughness. Increasing the content of Ni which is an element of austenite phase generation acts as a countermeasure to that tendency by suppressing the formation of δ-ferrite phase. This method has, however, a limitation from the point of the cost of Ni. Also an increase in the C content is effective for suppressing the generation of δ-ferrite phase but it induces the generation of carbide during tempering which results in a degradation of the corrosion resistance. Consequently, the C content should be limited. Regarding the amount of δ-ferrite phase, when the area ratio thereof exceeds 10%, the presence of δ-ferrite phase has a negative effect on the strength and toughness. So the amount of δ-ferrite phase should be limited to 10% or less.

Generally, an increase in the strength of a steel degrades the toughness and anti-stress corrosion cracking property. However, the strength can be improved without degrading the toughness and anti-stress corrosion cracking property by introducing C in an adequate amount and by dispersing Cu as fine precipitate particles into the matrix of stainless steel through heat treatment. Since the precipitation of fine Cu particles requires the precise control of the tempering conditions, both the tempering temperature and the tempering time need to be controlled.

The present invention provides a novel martensitic stainless steel having high toughness and high strength and excellent anti-stress corrosion cracking property, which characteristics were not achieved in conventional martensitic stainless steels, while considering a restriction of the microstructure induced by the increased C content as discussed above.

The following are the reasons for the limitations of the present invention.

(1) C: 0.06% or less

Carbon binds with Cr in the tempering stage to precipitate as a carbide which then degrades corrosion resistance, anti-stress corrosion cracking property, and toughness. Carbon content above 0.06% significantly enhances the degradation of those characteristics.

Therefore, the C content is specified as 0.06% or less.

(2) Cr: 12 to 16%

Chromium is a basic element to structure a martensitic stainless steel, and an important element to give corrosion resistance. However, a Cr content below 12% does not provide sufficient corrosion resistance, and that above 16% induces an increase of δ-ferrite phase which, in turn, leads to a degradation in the strength and toughness even when the other alloying elements are adjusted.

Accordingly, the content of Cr is specified to be within a range of from 12 to 16%.

(3) Si: 1.0% or less

Silicon, which functions as a de-oxidizer, is an essential element. But Si is a strong ferrite-generating element, and the presence of Si in an amount of more than 1.0% enhances the formation of δ-ferrite phase. Consequently, the Si content is specified as 1.0% or less.

(4) Mn: 2.0% or less

Manganese is effective as a de-oxidizer and a desulfurizing agent. Also, Manganese is effective as an austenite-generating element by suppressing the formation of δ-ferrite phase. However, excessive addition of Mn has a saturating effect, and therefore the Mn content is specified as 2.0% or less.

(5) Ni: 0.5 to 8.0%

Nickel is quite effective for improving corrosion resistance and for enhancing the formation of austenite phase. However, a Ni content below 0.5% does not have the effect. Since Ni is an expensive element, the upper limit of the Ni content is specified as 8.0%.

(6) Mo: 0.1 to 2.5%

Mo is a particularly effective element for improving corrosion resistance. However, a Mo content of less than 0.1% does not have the effect. A Mo content above 2.5% induces an excess amount of δ-ferrite phase, and so the upper limit of the Mo content is specified as 2.5%.

(7) Cu: 0.3 to 4.0%

Copper is an important element in this invention.

Copper is dissolved in the matrix in a form of a solid solution to improve the corrosion resistance, and also a part of the dissolved Cu is precipitated by tempering it so that it finely disperses in the matrix thereby improving the strength without degrading the anti-stress corrosion cracking property. However, a Cu content below 0.3% does not have a sufficient effect, and a content of above 4.0% saturates the effect and instead causes the development of cracks during hot working. Accordingly, the content of Cu is specified to be within a range of from 0.3 to 4.0%.

(8) N: 0.05% or less

Nitrogen is an effective element for improving the corrosion resistance and also for generating austenite phase. However, a N content above 0.05% enhances the binding with Cr during tempering to precipitate as a nitride, which degrades the anti-stress corrosion cracking property and toughness. Consequently, the N content is specified as 0.06% or less.

(9) Additional components V, Nb (V: 0.01 to 0.10%, Nb: 0.01 to 0.10%)

Vanadium and niobium are powerful elements for forming carbide. They form a fine carbide precipitate to make crystal grains fine and improve the anti-stress corrosion cracking property. However, they are also the elements which form ferrite phase and increase the amount of δ-ferrite phase.

Accordingly, the content of each of them is specified to a range of from 0.01 to 0.10%. A content below 0.010% does not have the effect of improving the anti-stress corrosion cracking property, and that above 0.10% has a saturating effect and increases the amount of δ-ferrite phase which, in turn, has a negative effect on the toughness. Therefore, both V and Nb are limited to a range of from 0.01 to 0.10% each.

(10) Area ratio of δ-ferrite phase: 10% or less

The δ-ferrite phase is a phase which was not transformed to martensite during the quench hardening of martensitic steel and was left as ferrite phase. An increased amount of δ-ferrite phase significantly degrades the toughness. In that type of steel, if the area ratio of the δ-ferrite phase expressed as a percent exceeds 10%, the degradation of the toughness is considerably enhanced. Accordingly, the upper limit of the area ratio of the δ-ferrite phase is specified as 10%.

(11) Fine precipitate of Cu

When precipitated in fine grains, Cu increases the strength of steel by the precipitation hardening effect without degrading the anti-stress corrosion cracking property which usually occurs along with the increase of the strength. The term "fine precipitate" refers to grains which are identifiable by observation under an electron microscope and which have an approximate size of 0.10 micron or less. When the Cu precipitate becomes coarse and exceeds 0.10 micron, however, the effect of improving the strength diminishes. Also when Cu does not precipitate and is left dissolved in the matrix, no improvement of the strength by precipitation hardening can be expected. Therefore, the Cu precipitate is specified as a fine precipitate. The dispersed amount is not specifically defined. Nevertheless, it is preferable that fine precipitation exists at a rate of 30 or more per 1 square micron of the matrix.

(12) Austenitizing temperature: from $Ac_3$ point to 980° C.

A temperature below $Ac_3$ point results in an insufficient austenitizing and fails to obtain necessary strength.

A temperature above 980° C. induces the occurrence of coarse grains, significantly degrades toughness, and also decreases anti-stress corrosion cracking property. Therefore, the temperature range for austenitizing is specified to be from $Ac_3$ to 980° C.

(13) Tempering temperature, T (° C): between 500° C. and either the lower one of 630° C. or $Ac_1$ Tempering is effective for softening the martensite structure to secure toughness and also for finely precipitating Cu into the matrix to increase the strength. However, if the tempering temperature is less than 500° C., the softening of the martensite structure is insufficient and the fine precipitation of Cu is insufficient, and this fails to produce a steel which has the expected level of performance. On the other hand, if the tempering temperature is above $Ac_1$, a part of the martensite structure is austenized again and the tempering is not performed to degrade the toughness. Also, if the tempering temperature is above 630° C. the once precipitated fine Cu grains dissolve again, and the steel fails to exhibit sufficient strength. Consequently, the tempering temperature is specified to be within a range between 500° C. and either the lower one of 630° C. or $Ac_1$.

(14) Tempering time, t (hour): the value of (20+log t)(273+T) being within a range of from 15200 to 17800

An excessively short tempering time results in insufficient Cu precipitation and fails to obtain a sufficient strength of the steel even if the tempering temperature is kept constant. An excessively long tempering time induces the coagulation and growth of coarse grains of once-precipitated fine Cu grains, and the Cu grains can not contribute to the improvement of the strength.

Therefore, the tempering time necessary to realize an appropriate increase in strength is limited to a certain range. The range, however, differs dependent on each tempering temperature applied.

The figure shows the relation of a temper parameter which is a variable function of the tempering temperature and tempering time, a 0.2% yield stress, and a Charpy impact energy. As shown in the figure, when the value of the temper parameter is within a range of from 15200 and 17800, the 0.2% yield stress is 75 kg/mm$^2$ or more and the Charpy impact energy is 10 kg-m or more, both values of which satisfy the target level of this invention. The temper parameter is defined by the following equation.

$$P=(20+\log t)\,(273+T)$$

where t: tempering time (hour)

T: tempering temperature (° C.)

Accordingly, the tempering time is specified by the tempering parameter which value is in a range of from 15200 to 17800. The range of from 15500 to 17000 is more preferable. Now, the method for making the invention steel will be given. The steel of this invention is prepared in a converter or an electric furnace so as to have a composition range as specified in this invention. The steel is subjected to ingot casting process or continuous casting process to form an ingot. The ingot undergoes hot working into a seamless pipe or a steel sheet, which is then processed by heat treatment. The method of heat treatment is done as described above.

As for the composition of the steel of this invention, the additional component Al , N, Ti, Zr, Ta, Hf, Ca, or rare earth metal (REM) may be used. These additional elements can often contribute to the further improvement of the performance of the steel of this invention. The purpose and adequate content of these individual elements are described below.

Al: Aluminium is added in order to effect oxygen removal, and the adequate content range is from 0.01 to 0.10%.

W: Tungsten is effective in $CO_2$ corrosion, while if it is added in an excess amount it degrades the toughness. Therefore, the maximum content is specified as 4%.

Ti, Zr, Ta, Hf: These elements are effective for improving the corrosion resistance, and an adequate content is max. 0.2%. The presence of these elements at more than 0.2% induces coarse grains which degrades the anti-stress corrosion cracking property.

Ca, REM: These elements bind to S, a harmful impurity in steel, and significantly reduce damage of the steel; they also improve the anti-stress corrosion cracking property. Excessive amounts of these elements, however, have the reverse effect on the anti-stress corrosion cracking property, so the adequate content is specified to be 0.01% or less for Ca and to be 0.02% or less for REM.

Inevitable impurities in steel contain P and S, both of which degrade the hot working performance and the anti-stress corrosion cracking property of steel. Accordingly, smaller amounts of P and S are better. Nevertheless, P content of 0.04% or less and S content of 0.01% or less, each satisfy the level of anti-stress corrosion cracking property being targeted by this invention and presents no problem for the manufacture of hot-rolled steel sheets or seamless steel pipes.

EXAMPLE

The present invention is described in more detail in the following example. The inventors prepared test ingots of Example steels Nos. 1 to 13 and Comparative Example steels Nos. a to j. Those ingots were subjected to hot rolling to form steel sheets having a thickness of 12 mm.

The steel sheets were then processed by the heat treatment described below to obtain the test specimens.

Example 1

Table 1 lists the principal components of the steel of this invention; and Table 2 shows other components and an $Ac_1$ and $Ac_3$ transformation temperature. These steels were austenitized 980° C. followed by cooling in air and tempering at 600° C. for 1 hour. The resulting steels were analyzed to determine the presence of δ-ferrite phase, the mechanical properties, and the anti-stress corrosion cracking property. The results are summarized in Table 3. The temper parameter of the tempering in Example 1 was 17460. The δ-ferrite phase was not detected in any specimens except for the steel Nos. 5, 8, and 14 where a slight amount of δ-ferrite phase was observed. As for the Cu precipitation, observation by an electron microscope with a magnitude of 100,000 was conducted immediately after the tempering to confirm that fine Cu grains having the approximate size range of from 0.001 to 0.10 micron were uniformly dispersed on the whole matrix area. The degree of dispersion was counted as being approximately 30 to 100 fine Cu precipitate grains per 1 square micron of the matrix surface.

For all the steel specimens tested, the 0.2% yield stress and the Charpy impact energy at 0° C. were above the target level, 75 kg/mm$^2$ and 10 kg-m, respectively. The anti-stress corrosion cracking property was tested and was found to conform to TMO1-77 of the NACE (National Association of Corrosion Engineers) Standard. Following the procedure of the Standard, a specimen was immersed into a mixture of 5% NaCl solution and 0.5% acetic acid aqueous solution saturated with $H_2S$ gas of 1 atm, and the specimen was subjected to a load of 60% to the 0.2% yield stress, (for example, steel No. 1 in Table 3 was subjected to a load of 76×0.6=45.6 kg/mm$^2$). The time to failure on SSC (Sulphide Stress Corrosion) test was determined. The results are summarized in Table 3 "SSC hours". As can be seen in Table 3, no steel among the steel Nos. 1 through 16 failed before 720 hours had passed.

In the evaluation of the corrosion resistance to $CO_2$, a specimen was immersed into a 10% NaCl aqueous solution in an autoclave at 200° C., 30 atm., $H_2S$ partial pressure of 0.05 atm. for 336 hours. Then, the mass loss was determined. For all the steels' Nos. 1 to 16, the mass loss was 0.5 g/m$^2$ or less, which was considerably lower than 1.0 g/mm$^2$, which was the minimum required level for conventional martensite stainless steels. Consequently, the steels of this invention were confirmed to have excellent corrosion resistance.

TABLE 1

| | Chemistry (principal elements, wt %) | | | | | | | | | |
|---|---|---|---|---|---|---|---|---|---|---|
| Steel No. | C | Si | Mn | P | S | Ni | Cr | Mo | N | Cu |
| 1 | 0.025 | 0.16 | 0.05 | 0.009 | 0.002 | 4.86 | 14.7 | 2.07 | 0.002 | 0.35 |
| 2 | 0.024 | 0.15 | 0.05 | 0.008 | 0.002 | 4.83 | 14.8 | 2.06 | 0.002 | 1.82 |
| 3 | 0.023 | 0.14 | 0.05 | 0.007 | 0.002 | 4.77 | 14.8 | 2.07 | 0.002 | 2.63 |
| 4 | 0.025 | 0.15 | 0.05 | 0.009 | 0.002 | 4.85 | 14.7 | 2.04 | 0.002 | 3.95 |
| 5 | 0.023 | 0.14 | 0.05 | 0.007 | 0.002 | 4.77 | 15.5 | 1.23 | 0.002 | 2.63 |
| 6 | 0.022 | 0.17 | 0.07 | 0.007 | 0.002 | 4.96 | 14.1 | 2.06 | 0.002 | 2.61 |
| 7 | 0.022 | 0.17 | 0.08 | 0.011 | 0.002 | 4.81 | 14.2 | 2.06 | 0.002 | 2.62 |
| 8 | 0.026 | 0.16 | 0.06 | 0.009 | 0.002 | 4.88 | 15.1 | 2.04 | 0.002 | 2.61 |
| 9 | 0.027 | 0.16 | 0.05 | 0.009 | 0.002 | 4.86 | 14.1 | 2.07 | 0.002 | 2.65 |
| 10 | 0.024 | 0.15 | 0.05 | 0.008 | 0.002 | 4.83 | 14.3 | 2.06 | 0.002 | 2.62 |
| 11 | 0.022 | 0.15 | 0.05 | 0.009 | 0.002 | 4.82 | 14.2 | 2.02 | 0.002 | 2.65 |
| 12 | 0.024 | 0.15 | 0.05 | 0.008 | 0.002 | 4.83 | 14.3 | 1.06 | 0.002 | 2.63 |
| 13 | 0.023 | 0.15 | 0.05 | 0.011 | 0.002 | 4.85 | 14.2 | 2.04 | 0.002 | 2.65 |
| 14 | 0.017 | 0.47 | 1.05 | 0.010 | 0.002 | 7.21 | 14.7 | 2.01 | 0.004 | 1.03 |
| 15 | 0.013 | 0.17 | 0.17 | 0.009 | 0.002 | 4.19 | 15.8 | 0.30 | 0.0042 | 1.02 |
| 16 | 0.053 | 0.16 | 0.18 | 0.009 | 0.002 | 0.78 | 12.2 | 2.42 | 0.003 | 1.98 |

TABLE 2

| Steel | Chemistry (principal elements, wt %) | | | | | | | Transformation temperature (°C.) | |
|---|---|---|---|---|---|---|---|---|---|
| No. | Nb | V | Al | W | Ti | Ta | Ca | Ac3 | Ac1 |
| 1 | — | — | 0.024 | — | — | — | — | 710 | 610 |
| 2 | — | — | 0.025 | — | — | — | — | 730 | 630 |
| 3 | — | — | 0.028 | — | — | — | — | 730 | 630 |
| 4 | — | — | 0.023 | — | — | — | — | 740 | 640 |
| 5 | — | — | 0.028 | 1.96 | — | — | — | 730 | 630 |
| 6 | — | — | 0.021 | — | 0.20 | — | — | 730 | 630 |
| 7 | — | 0.20 | 0.021 | — | — | — | — | 730 | 630 |
| 8 | 0.05 | | 0.022 | — | — | — | — | 730 | 630 |
| 9 | — | — | 0.024 | — | — | 0.05 | — | 730 | 630 |
| 10 | — | — | 0.025 | — | — | — | 0.005 | 730 | 630 |
| 11 | 0.02 | — | 0.024 | — | — | 0.05 | — | 730 | 630 |
| 12 | — | — | 0.025 | 2.13 | — | — | 0.005 | 730 | 630 |
| 13 | 0.01 | 0.15 | 0.023 | — | — | — | 0.004 | 730 | 630 |
| 14 | — | — | 0.021 | — | — | — | — | 700 | 600 |
| 15 | — | — | 0.020 | — | — | — | — | 750 | 650 |
| 16 | — | — | 0.025 | — | — | — | — | 850 | 760 |

TABLE 3

| Steel No. | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|
| Area ratio of δ-ferrite phase (%) | 0 | 0 | 0 | 0 | 3 | 0 | 0 | 0 | 0 | 0 | 0 | 0 | 0 | 3 | 0 | 0 |
| Diameter of Cu precipitate grain (micron) | Dispersion of Cu precipitate grains of 0.001–0.1 micron size on the whole matrix surface | | | | | | | | | | | | | | | |
| 0.2% yield stress | 76 | 80 | 82 | 84 | 83 | 84 | 84 | 83 | 82 | 83 | 82 | 84 | 83 | 82 | 79 | 81 |
| CVN (kg-m) | 15 | 15 | 14 | 12 | 10 | 11 | 13 | 10 | 11 | 13 | 11 | 13 | 12 | 14 | 15 | 12 |
| SSC (hour) | No fracture occurred before 720 hours of test (>720) | | | | | | | | | | | | | | | |
| Total judgment | ○ | ○ | ○ | ○ | ○ | ○ | ○ | ○ | ○ | ○ | ○ | ○ | ○ | ○ | ○ | ○ |

Note: Symbol mark of "○" means "satisfactory"

Example 2

The steel No. 3 in Tables 1 and 2 was processed at various austenitization temperatures. The results are shown in a part of Table 4 (the austenitization temperature is designated as the quench hardening temperature). In all cases, the steel was austenitized followed by cooling in air, and tempering at 600° C. for 1 hour. The temper parameter at the tempering in Example 2 was 17460. When the austenitization temperature stayed with the range specified for this invention, the performance obtained was satisfactory. However, when the austenitization temperature was as low as 700° C., the insufficient austenitization resulted in a poor performance with characteristics lower than the target level. When the austenitization temperature was as high as 1000° C., the level of toughness obtained was low and the anti-stress corrosion cracking property was also poor.

TABLE 4

| Test Name | Quench hardening temperature (°C.) | Tempering temperature (°C.) | Tempering time (hour) | T.P. | Size of Cu precipitate (micron) | 0.2% yield stress (kg/mm$^2$) | CVN (kg-m) | SSC (hour) | Total judgment |
|---|---|---|---|---|---|---|---|---|---|
| Example 2 (Steel No. 3) | 700 | 600 | 1.00 | 17460 | 0.001–0.1 micron | 73 | 13 | >720 | X |
| | 850 | | | | | 82 | 12 | >720 | ○ |
| | 900 | | | | | 83 | 13 | >720 | ○ |
| | 980 | | | | | 82 | 14 | >720 | ○ |
| | 1000 | | | | | 86 | 7 | <100 | X |
| Example 3 (Steel No. 3) | 950 | 450 | 1.00 | 14460 | No precipitation occurred | 101 | 7 | <100 | X |
| | | 500 | | 15460 | 0.001–0.1 micron | 107 | 10 | >720 | ○ |
| | | 550 | | 16460 | | 104 | 10 | >720 | ○ |
| | | 600 | | 17460 | | 83 | 13 | >720 | ○ |
| | | 630 | | 18060 | | 70 | 14 | >720 | ○ |
| | | 350 | | 18460 | No precipitation occurred | 64 | 13 | >720 | X |

(Note 1) In all cases, no δ-ferrite phase appeared.
(Note 2) CVN designates the Charpy impact energy at 0° C..
(Note 3) SSC designates the fracture time.
(Note 4) T.P. designates the temper parameter.
(Note 5) Symbol mark of "○" means "satisfactory".
Symbol mark of "X" means "poor".

Example 3

The test condition was the varied tempering temperature while maintaining the austenitization temperature at 950° C. The result is shown in a part of Table 4. Also in this case, steel No. 3 was used, and the steel was austenitized followed by cooling in air, and tempering at 600° C. for 1 hour.

When the tempering temperature stayed within a range of this invention, the performance obtained was favorable. However, when the tempering temperature was 450° C., lower than the range of this invention, the martensite structure stayed in a hard and brittle state, so the toughness was poor and the anti-stress corrosion cracking property was also poor.

Furthermore, no Cu precipitation occurred. On the other hand, when the tempering temperature was 650° C., higher than the $Ac_1$ point, fine Cu precipitate grains were not present because they had dissolved again, so the strength was decreased.

Example 4

In Example 4, the effect of the temper parameter as a variable of tempering was observed. Also in this case, steel No. 5 was austenitized followed by cooling in air, and tempering at a temperature range of from 450° to 680° C. The results are shown in Table 5.

As seen in Table 5, even when the tempering temperature was 500° C., the Charpy impact energy was lower than the target level if the tempering time was as short as 0.10 hour (giving the temper parameter of 14690). On the other hand, when the tempering time was 0.5 hours or longer, the temper parameter became 15200 or more, which gave sufficient strength and toughness and a favorable anti-stress corrosion crack property.

In the case that the tempering temperature was 550° C., the tempering was carried out within a temper parameter range of from 15200 to 17800, and the target level was attained.

When the tempering temperature was 600° C., a steel processed under a tempering time of 1.0 hour gave a temper parameter range of from 15200 to 17800, so the target level of performance was attained. However, a steel treated at the tempering time of 5 hrs gave a temper parameter of above 17800, which suggests that the Cu precipitate had dissolved again or had coarse grains to resulting in a degradation of the strength and to an insufficient anti-stress corrosion cracking property.

TABLE 5

| Quench hardening temperature (°C.) | Tempering temperature (°C.) | Tempering time (hour) | T.P. | Size of Cu precipitate (micron) | 0.2% yield stress (kg/mm$^2$) | CVN (kg-m) | SSC (hour) | Total judgment |
|---|---|---|---|---|---|---|---|---|
| 950 | 450 | 0.25 | 14020 | No precipitation occurred | 102 | 3 | <100 | X |
| | 500 | 0.10 | 14690 | 0.001–0.1 micron | 104 | 7 | <100 | X |
| | | 0.50 | 15230 | | 106 | 11 | >720 | ○ |
| | | 5.00 | 16000 | | 108 | 10 | >720 | ○ |
| | 550 | 1.00 | 16460 | | 103 | 12 | >720 | ○ |
| | | 5.00 | 17040 | | 92 | 13 | >720 | ○ |
| | 600 | 1.00 | 17460 | | 83 | 12 | >720 | ○ |
| | | 5.00 | 18070 | coarse | 70 | 13 | <100 | X |
| | 650 | 1.00 | 18460 | No precipitation | 63 | 12 | <100 | X |
| | | 5.00 | 19110 | occurred | 57 | 13 | <100 | X |
| | 680 | 5.00 | 19730 | | 55 | 10 | <100 | X |

(Note 1) In all cases, no δ-ferrite phase appeared.
(Note 2) CVN designates the Charpy impact energy at 0° C..
(Note 3) SSC designates the fracture time.
(Note 4) T.P. designates the temper parameter.
(Note 5) Symbol mark of "○" means "satisfactory".
Symbol mark of "X" means "poor".

Comparative Example

Among the Comparative Examples, those which used steels having a composition which is outside the specified range of this invention are listed in Tables 6 and 7 in terms of their composition and test results. The applied austenitization temperature and tempering treatment are the same as in Example 1. Since the steels in Table 6 had at least one component present in an amount outside of the specified range of this invention, the test results gave lower levels of strength or toughness than the target levels of this invention. As a result, the target level of this invention for the anti-stress corrosion cracking property could not be attained. Steels (a) and (b) contained Cu at below 0.3%, and no Cu precipitate was formed, which resulted in a strength of less than 75 kg/mm$^2$. Steel (c) contained Cu at above 4.0%, and it suffered cracks during the hot-rolling stage which leads to a significant degradation of the commercial value of the product. Steel (c) also showed a poor SSC characteristic. Steel (d) had a low Ni content, and steel (g) had high content of Cr and Mo, and steel (i) had a high content of Mo, so they gave delta-ferrite phase over 10% of area ratio, which significantly degraded the toughness. Steel (e) had Ni content above 9%, so that the steel was very expensive.

Therefore, steel (e) was inadequate for the object of this invention. Also steel (e) was inferior in SSC performance. Steel (f) had a low Cr content and steel (h) had a low Mo content, so those steels were inferior in corrosion resistance to CO2. Steel (j) had a high C content so that the SSC performance was poor.

TABLE 6

| Steel | Chemistry(wt %) | | | | | | | | | | |
|---|---|---|---|---|---|---|---|---|---|---|---|
| No. | C | Si | Mn | P | S | Ni | Cr | Mo | N | Cu | Al |
| a | 0.024 | 0.15 | 0.05 | 0.008 | 0.002 | 4.81 | 14.8 | 2.06 | 0.002 | 0.02 | 0.023 |
| b | 0.026 | 0.16 | 0.06 | 0.009 | 0.002 | 4.88 | 14.7 | 2.04 | 0.002 | 0.21 | 0.023 |
| c | 0.023 | 0.15 | 0.05 | 0.007 | 0.002 | 4.96 | 14.8 | 2.06 | 0.002 | 4.61 | 0.026 |
| d | 0.024 | 0.14 | 0.09 | 0.007 | 0.002 | 0.37 | 14.8 | 2.07 | 0.002 | 2.63 | 0.027 |
| e | 0.025 | 0.13 | 0.09 | 0.007 | 0.002 | 9.97 | 14.8 | 2.06 | 0.002 | 2.61 | 0.026 |
| f | 0.024 | 0.14 | 0.09 | 0.008 | 0.002 | 4.81 | 10.8 | 2.06 | 0.002 | 2.62 | 0.021 |
| g | 0.026 | 0.16 | 0.06 | 0.011 | 0.002 | 1.88 | 18.7 | 3.04 | 0.002 | 2.61 | 0.023 |
| h | 0.025 | 0.16 | 0.05 | 0.012 | 0.002 | 4.86 | 14.7 | 0.05 | 0.002 | 2.55 | 0.024 |
| i | 0.024 | 0.17 | 0.09 | 0.008 | 0.002 | 4.83 | 15.8 | 3.53 | 0.002 | 2.62 | 0.025 |
| j | 0.085 | 0.17 | 0.05 | 0.009 | 0.002 | 4.85 | 14.7 | 2.04 | 0.002 | 2.55 | 0.023 |

TABLE 7

| Steel No. | a | b | c | d | e | f | g | h | i | j |
|---|---|---|---|---|---|---|---|---|---|---|
| Transformation temperature (°C.) | | | | | | | | | | |
| Ac3 | 700 | 700 | 750 | 850 | 600 | 740 | 800 | 730 | 730 | 730 |
| Ac1 | 600 | 600 | 650 | 750 | 500 | 640 | 700 | 630 | 630 | 630 |
| Area ratio of δ-ferrite phase (%) | 0 | 0 | 0 | 15 | 0 | 0 | 20 | 0 | 15 | 0 |
| Diameter of Cu precipitate grain (micron) | No Cu precipitate occured | | 1–3 | | | 0.001–0.1 micron | | | | |
| 0.2% yield stress (kg/mm$^2$) | 72 | 73 | 83 | 82 | 83 | 82 | 82 | 82 | 81 | 85 |
| CVN (kg-m) | 16 | 15 | 10 | 3 | 12 | 10 | 2 | 11 | 3 | 10 |
| SSC(hour) | 100 hours or less | 100 hours or less | 100 hours or less | 100 hours or less | 100 hours or less | 100 hours or less | 100 hours or less | 100 hours or less | 100 hours or less | 100 hours or less |
| Total judgment | X | X | X | X | X | X | X | X | X | X |

(Note 1) CVN: Charpy impact energy at 0° C.
(Note 2) SSC designates fracture time

What is claimed is:

1. A high strength martensitic stainless steel consisting essentially of:

0.06 wt. % or less C, 12 to 16 wt. % Cr, 1 wt. % or less Si, 2 wt. % or less Mn, 0.5 to 8 wt. % Ni, 0.1 to 2.5 wt. % Mo, 0.3 to 4 wt. % Cu, 0.05 wt. % or less N, and the balance being Fe and inevitable impurities;

said steel having an area ratio of a δ-ferrite phase of at most 10% expressed as a percent;

said steel including at least 30 fine copper precipitates per 1 square micron meter (μm$^2$); and said steel having a 0.2% yield stress of 75 kg/mm$^2$ or more and a charpy impact energy of 10 kg-m or more.

2. The martensitic stainless steel of claim 1, wherein the C content is from 0.013 to 0.053 wt. %.

3. The martensitic stainless steel of claim 1, wherein the Cr content is from 12.2 to 15.8 wt. %.

4. The martensitic stainless steel of claim 1, wherein the Si content is from 0.14 to 0.47 wt. %.

5. The martensitic stainless steel of claim 1, wherein the Mn content is from 0.05 to 1.05 wt. %.

6. The martensitic stainless steel of claim 1, wherein the Ni content is from 0.78 to 7.21 wt. %.

7. The martensitic stainless steel of claim 1, wherein the Mo content is from 0.30 to 2.42 wt. %.

8. The martensitic stainless steel of claim 1, wherein said steel has an area ratio of δ-ferrite phase of at most 3%.

9. The martensitic stainless steel of claim 1, wherein said fine copper precipitates have diameters of 0.1 micron meters or less.

10. A high strength martensitic stainless steel consisting essentially of:

0.06 wt. % or less C, 12 to 16 wt. % Cr, 1 wt. % or less Si, 2 wt. % or less Mn, 0.5 to 8 wt. % Ni, 0.1 to 2.5 wt. % Mo, 0.3 to 4 wt. % Cu, 0.05 wt. % or less N, at least one element selected from the group consisting of 0.01 to 0.1 wt. % V, 0.01 to 0.1 wt. % Nb, and the balance being Fe and inevitable impurities;

said steel having an area ratio of a δ-ferrite phase of 10% or less expressed as a percent;

said steel including at least 30 fine copper precipitates per 1 square micron meter (μm$^2$); and said steel having a 0.2% yield stress of 75 kg/mm$^2$ or more and a charpy impact energy of 10 kg-m or more.

11. The martensitic stainless steel of claim 10, wherein the C content is from 0.013 to 0.053 wt. %.

12. The martensitic stainless steel of claim 10, wherein the Cr content is from 12.2 to 15.8 wt. %.

13. The martensitic stainless steel of claim 10, wherein the Si content is from 0.14 to 0.47 wt. %.

14. The martensitic stainless steel of claim 10, wherein the Mn content is from 0.05 to 1.05 wt. %.

15. The martensitic stainless steel of claim 10, wherein the Ni content is from 0.78 to 7.21 wt. %.

16. The martensitic stainless steel of claim 10, wherein the Mo content is from 0.30 to 2.42 wt. %.

17. The martensitic stainless steel of claim 10, wherein said steel has an area ratio of δ-ferrite phase of at most 3%.

18. The martensitic stainless steel of claim 10, wherein said fine copper precipitates have diameters of 0.1 micron meters or less.

19. A method for manufacturing a high strength martensitic stainless steel comprising the steps of:

preparing a martensitic stainless steel steel consisting essentially of 0.06 wt. % or less C, 12 to 16 wt. % Cr, 1 wt. % or less Si, 2 wt. % or less Mn, 0.5 to 8 wt. % Ni, 0.1 to 2.5 wt. % Mo, 0.3 to 4 wt. % Cu, 0.05 wt. % or less N, and the balance being Fe and inevitable impurities;

austenitizing said martensitic stainless steel at a temperature of $Ac_3$ transformation point to 980° C. to produce a austenitized martensitic steel;

cooling the austenitized martensitic stainless steel;

tempering the cooled stainless steel to disperse fine Cu precipitate grains in a matrix at a tempering temperature (T°C.) of 500° C. to the lower one of either 630° C. or $Ac_1$ transformation point and at a tempering time (t hour), said tempering temperature and said tempering time satisfying the following equation:

$$15200 \leqq (20+\log t)(273+T) \leqq 17800.$$

20. The method of claim 19, wherein said $Ac_3$ transformation point is from 700° to 850° C.

21. The method of claim 19, wherein said $Ac_1$ transformation point is from 600° to 760° C.

22. The method of claim 19, wherein said tempering temperature (T°C.) and said tempering time (t hour) satisfying the following equation;

$$15500 \leqq (20+\log t)(273+T) \leqq 17000.$$

23. The martensitic stainless steel of claim 19, wherein the C content is from 0.013 to 0.053 wt. %.

24. The martensitic stainless steel of claim 19, wherein the Cr content is from 12.2 to 15.8 wt. %.

25. The martensitic stainless steel of claim 19, wherein the Si content is from 0.14 to 0.47 wt. %.

26. The martensitic stainless steel of claim 19, wherein the Mn content is from 0.05 to 1.05 wt. %.

27. The martensitic stainless steel of claim 19, wherein the Ni content is from 0.78 to 7.21 wt. %.

28. The martensitic stainless steel of claim 19, wherein the Mo content is from 0.30 to 2.42 wt. %.

29. A method for manufacturing a high strength martensitic stainless steel comprising the steps of:

preparing a martensitic stainless steel steel consisting essentially of 0.06 wt. % or less C, 12 to 16 wt. % Cr, 1 wt. % or less Si, 2 wt. % or less Mn, 0.5 to 8 wt. % Ni, 0.1 to 2.5 wt. % Mo, 0.3 to 4 wt. % Cu, 0.05 wt. % or less N, at least one element selected from the group consisting of 0.01 to 0.1 wt. % V and 0.01 to 0.1 wt. % Nb and the balance being Fe and inevitable impurities; and the balance being Fe and inevitable impurities;

austenitizing said martensitic stainless steel at a temperature of $Ac_3$ transformation point to 980° C. to produce a austenitized martensitic steel;

cooling the austenitized martensitic stainless steel;

tempering the cooled stainless steel to disperse fine Cu precipitate grains in a matrix at a tempering temperature (T°C.) of 500° C. to the lower one of either 630° C. or $Ac_1$ transformation point and at a tempering time (t hour), said tempering temperature and said tempering time satisfying the following equation:

$$15200 \leqq (20+\log t)(273+T) \leqq 17800.$$

30. The method of claim 29, wherein said $Ac_3$ transformation point is from 700° to 850° C.

31. The method of claim 29, wherein said $Ac_1$ transformation point is from 600° to 760° C.

32. The method of claim 29, wherein said tempering temperature (T°C.) and said tempering time (t hour) satisfying the following equation;

$$15500 \leqq (20+\log t)(273+T) \leqq 17000.$$

33. The martensitic stainless steel of claim 29, wherein the C content is from 0.013 to 0.053 wt. %.

34. The martensitic stainless steel of claim 29, wherein the Cr content is from 12.2 to 15.8 wt. %.

35. The martensitic stainless steel of claim 29, wherein the Si content is from 0.14 to 0.47 wt. %.

36. The martensitic stainless steel of claim 29, wherein the Mn content is from 0.05 to 1.05 wt. %.

37. The martensitic stainless steel of claim 29, wherein the Ni content is from 0.78 to 7.21 wt. %.

38. The martensitic stainless steel of claim 19, wherein the Mo content is from 0.30 to 2.42 wt. %.

39. A high strength martensitic stainless steel having a composition consisting essentially of:

0.06 wt. % or less C, 12 to 16 wt. % Cr, 1 wt. % or less Si, 2 wt. % or less Mn, 0.5 to 8 wt. % Ni, 0.1 to 2.5 wt. % Mo, 0.3 to 4 wt. % Cu, 0.05 wt. % or less N, at least one element selected from the group consisting of 0.01 wt. % to 0.1 wt. % V, 0.01 to 0.1 wt. % Nb, and optionally at least one additional element selected from the group consisting of 0.01 to 0.10 wt. % Al, 4 wt. % or less W, 0.2 wt. % or less Ti, 0.2 wt. % or less Zr, 0.2 wt. % or less Ta, 0.2 wt. % or less Hf, 0.01 wt. % or less of Ca and 0.02 wt. % or less of a rare earth metal; and the balance being Fe and inevitable impurities including no more than 0.04 wt. % P and no more than 0.01 wt. % S;

said steel having an area ratio of a δ-ferrite phase of 10% or less expressed as a percent;

said steel including at least 30 fine copper precipitates per 1 $\mu m^2$; and said steel having a 0.2% yield stress of 75 $kg/mm^2$ or more and a charpy impact energy of 10 kg-m or more.

40. The martensitic stainless steel of claim 39, wherein the composition is selected from the group consisting of (a) 0.025 wt. % C, 0.16 wt. % Si, 0.05 wt. % Mn, 0.009 wt. % P, 0.002 wt. % S, 4.86 wt. % Ni, 14.7 wt. % Cr, 2.07 wt. % Mo, 0.002 wt. % N, 0.35 wt. % Cu, 0.024 wt. % Al and the remainder being Fe;

(b) 0.024 wt. % C, 0.15 wt. % Si, 0.05 wt. % Mn, 0.008 wt. % P, 0.002 wt. % S, 4.83 wt. % Ni, 14.8 wt. % Cr, 2.06 wt. % Mo, 0.002 wt. % N, 1.82 wt. % Cu, 0.025 wt. % Al and the remainder being Fe;

(c) 0.023 wt. % C, 0.14 wt. % Si, 0.05 wt. % Mn, 0.007 wt. % P, 0.002 wt. % S, 4.77 wt. % Ni, 14.8 wt. % Cr, 2.07 wt. % Mo, 0.002 wt. % N, 2.63 wt. % Cu, 0.028 wt. % Al and the remainder being Fe;

(d) 0.025 wt. % C, 0.15 wt. % Si, 0.05 wt. % Mn, 0.009 wt. % P, 0.002 wt. % S, 4.85 wt. % Ni, 14.7 wt. % Cr, 2.04 wt. % Mo, 0.002 wt. % N, 3.95 wt. % Cu, 0.023 wt. % Al and the remainder being Fe;

(e) 0.023 wt. % C, 0.14 wt. % Si, 0.05 wt. % Mn, 0.007 wt. % P, 0.002 wt. % S, 4.77 wt. % Ni, 15.5 wt. % Cr, 1.23 wt. % Mo, 0.002 wt. % N, 2.63 wt. % Cu, 0.028 wt. % Al, 1.96 wt. % W and the remainder being Fe;

(f) 0.022 wt. % C, 0.17 wt. % Si, 0.07 wt. % Mn, 0.007 wt. % P, 0.002 wt. % S, 4.96 wt. % Ni, 14.1 wt. % Cr, 2.06 wt. % Mo, 0.002 wt. % N, 2.61 wt. % Cu, 0.021 wt. % Al, 0.20 wt. % Ti and the remainder being Fe;

(g) 0.022 wt. % C, 0.17 wt. % Si, 0.08 wt. % Mn, 0.011 wt. % P, 0.002 wt. % S, 4.81 wt. % Ni, 14.2 wt. % Cr, 2.06 wt. % Mo, 0.002 wt. % N, 2.62 wt. % Cu, 0.20 wt. % V, 0.021 wt. % Al and the remainder being Fe;

(h) 0.026 wt. % C, 0.16 wt. % Si, 0.06 wt. % Mn, 0.009 wt. % P, 0.002 wt. % S, 4.88 wt. % Ni, 15.1 wt. % Cr, 2.04 wt. % Mo, 0.002 wt. % N, 2.61 wt. % Cu, 0.05 wt. % Nb, 0.022 wt. % Al and the remainder being Fe;

(i) 0.027 wt. % C, 0.16 wt. % Si, 0.05 wt. % Mn, 0.009 wt. % P, 0.002 wt. % S, 4.86 wt. % Ni, 14.1 wt. % Cr, 2.07 wt. % Mo, 0.002 wt. % N, 2.65 wt. % Cu, 0.024 wt. % Al, 0.05 wt. % Ta and the remainder being Fe;

(j) 0.024 wt. % C, 0.15 wt. % Si, 0.05 wt. % Mn, 0.008 wt. % P, 0.002 wt. % S, 4.83 wt. % Ni, 14.3 wt. % Cr, 2.06 wt. % Mo, 0.002 wt. % N, 2.62 wt. % Cu, 0.025 wt. % Al, 0.005 wt. % Ca and the remainder being Fe;

(k) 0.022 wt. % C, 0.15 wt. % Si, 0.05 wt. % Mn, 0.009 wt. % P, 0.002 wt. % S, 4.82 wt. % Ni, 14.2 wt. % Cr, 2.02 wt. % Mo, 0.002 wt. % N, 2.65 wt. % Cu, 0.02 wt. % Nb, 0.024 wt. % Al, 0.05 wt. % Ta and the remainder being Fe;

(l) 0.024 wt. % C, 0.15 wt. % Si, 0.05 wt. % Mn, 0.008 wt. % P, 0.002 wt. % S, 4.83 wt. % Ni, 14.3 wt. % Cr, 1.06 wt. % Mo, 0.002 wt. % N, 2.63 wt. % Cu, 0.025 wt. % Al, 2.13 wt. % W, 0.005 wt. % Ca and the remainder being Fe;

(m) 0.023 wt. % C, 0.15 wt. % Si, 0.05 wt. % Mn, 0.011 wt. % P, 0.002 wt. % S, 4.85 wt. % Ni, 14.2 wt. % Cr, 2.04 wt. % Mo, 0.002 wt. % N, 2.65 wt. % Cu, 0.01 wt.

% Nb, 0.15 wt. % V, 0.023 wt. % Al, 0.004 wt. % Ca and the remainder being Fe;

(n) 0.017 wt. % C, 0.47 wt. % Si, 1.05 wt. % Mn, 0.010 wt. % P, 0.002 wt. % S, 7.21 wt. % Ni, 14.7 wt. % Cr, 2.01 wt. % Mo, 0.004 wt. % N, 1.03 wt. % Cu, 0.021 wt. % Al and the remainder being Fe;

(o) 0.013 wt. % C, 0.17 wt. % Si, 0.17 wt. % Mn, 0.009 wt. % P, 0.002 wt. % S, 4.19 wt. % Ni, 15.8 wt. % Cr, 0.30 wt. % Mo, 0.0042 wt. % N, 1.02 wt. % Cu, 0.020 wt. % Al and the remainder being Fe; and (p) 0.053 wt. % C, 0.16 wt. % Si, 0.18 wt. % Mn, 0.009 wt. % P, 0.002 wt. % S, 0.78 wt. % Ni, 12.2 wt. % Cr, 2.42 wt. % Mo, 0.003 wt. % N, 1.98 wt. % Cu, 0.025 wt. % Al and the remainder being Fe.

* * * * *

UNITED STATES PATENT AND TRADEMARK OFFICE

CERTIFICATE OF CORRECTION

PATENT NO. : 5,496,421

DATED : March 5, 1996

INVENTOR(S) : HASHIZUME et al

It is certified that error appears in the above-identified patent and that said Letters Patent is hereby corrected as shown below:

On the Title Page, left column, [56] References Cited, under U.S. PATENT DOCUMENTS, insert

| | | |
|---|---|---|
| --5,089,067 | 2/1992 | Schumacher |
| 3,720,545 | 3/1973 | Steven et al |
| 5,035,855 | 7/1991 | Utsunomiya et al |
| 5,232,520 | 8/1993 | Oka et al-- |

under FOREIGN PATENT DOCUMENTS, insert

| | | |
|---|---|---|
| --0 257 780 | 3/1988 | Europe |
| 0 384 317 | 8/1990 | Europe |
| 2 550 226 | 2/1985 | France |
| 40 39 538 | 6/1991 | Germany-- |

Column 2, line 30, delete "steel".

Column 6, line 8, delete "figure" and insert --FIGURE--.

Column 6, line 25, "Now" should begin a new paragraph.

UNITED STATES PATENT AND TRADEMARK OFFICE

CERTIFICATE OF CORRECTION

PATENT NO. : 5,496,421

DATED : March 5, 1996

INVENTOR(S) : HASHIZUME et al

It is certified that error appears in the above-identified patent and that said Letters Patent is hereby corrected as shown below:

Column 7, line 1, delete "EXAMPLE" and insert --EXAMPLES--.

Column 15, line 50 (claim 36), delete "claim 29" and insert --claim 19--.

Column 15, line 52 (claim 37), delete "claim 29" and insert --claim 19--.

Signed and Sealed this

Twenty-seventh Day of January, 1998

*Attest:*

Bruce Lehman

BRUCE LEHMAN

*Attesting Officer*

*Commissioner of Patents and Trademarks*